US007775377B2

(12) United States Patent
Abney

(10) Patent No.: US 7,775,377 B2
(45) Date of Patent: Aug. 17, 2010

(54) HAIR RACK

(76) Inventor: Michael A. Abney, P.O. Box 402, Bakersfield, CA (US) 93302

( * ) Notice: Subject to any disclaimer, the term of this patent is extended or adjusted under 35 U.S.C. 154(b) by 399 days.

(21) Appl. No.: 11/474,164

(22) Filed: Jun. 23, 2006

(65) Prior Publication Data

US 2006/0289368 A1 Dec. 28, 2006

Related U.S. Application Data

(60) Provisional application No. 60/694,147, filed on Jun. 23, 2005.

(51) Int. Cl.
*A47F 7/00* (2006.01)

(52) U.S. Cl. ..... 211/13.1

(58) Field of Classification Search ..... 211/13.1, 211/60.1, 61, 71.01, 85, 196, 197, 205, 107, 211/96, 101

See application file for complete search history.

(56) References Cited

U.S. PATENT DOCUMENTS 158,208 A * 12/1874 Hall ..... 211/67
1,221,517 A * 4/1917 Dunbar ..... 211/70
1,888,324 A * 11/1932 Matthai ..... 211/74
2,270,331 A * 1/1942 Noble ..... 335/285
4,380,296 A * 4/1983 Murray et al. ..... 209/704
5,819,961 A * 10/1998 Harris ..... 211/196
6,913,230 B2 * 7/2005 Wells ..... 248/127
6,938,766 B1 * 9/2005 Lee ..... 206/388
2001/0019095 A1 * 9/2001 Valiulis ..... 248/188.7

* cited by examiner

*Primary Examiner*—Sarah Purol
(74) *Attorney, Agent, or Firm*—Antonelli, Terry, Stout & Kraus, LLP.

(57) ABSTRACT

A rack for holding and organizing hair extensions comprises a vertical stand upon which a cylindrical member is attached at the upper end. A plurality of rack arms radiate outwardly from the cylindrical member. Each rack harm comprises a plurality of parallel and spaced apart teeth, the teeth having a groove between them. The width of the groove is sized such that the individual strands of hair of the extension fit through the groove, but the protein polymer at the end of the extension is too large to fit through the groove, such that the extensions may be suspended from the rack arms. The rack arms may be angled to facilitate placing extensions within the grooves, and removing the extensions from the grooves.

12 Claims, 6 Drawing Sheets

HAIR RACK

CROSS-REFERENCE TO RELATED APPLICATION

U.S. Provisional Application No. 60/694,147 was filed for this invention on Jun. 23, 2005 for which this inventor claims domestic priority.

BACKGROUND OF THE INVENTION

The present invention generally relates to apparatuses and methods for styling, grooming and enhancing human hair. It more specifically relates to apparatuses and methods which assist a hair stylist in preparing hair extensions for attachment to a person's head, and to assist the hair stylist in the application process.

It is known to attach hair extensions to a person's existing hair. An extension is a plurality or bundle of individual hairs, each hair usually of a consistent length. Usually each extension is attached to existing hair strands close to the client's head, perhaps about one quarter inch away from the scalp. When applied properly, the extensions blend in naturally with the client's own hair, providing additional length and/or fullness to the client's existing hair style. Typically, the extensions come in lengths of eight, twelve, sixteen, eighteen, twenty and twenty-four inches.

Various methods of attaching the hair extensions are known. One method employs a protein polymer which is affixed at the end of the extension, holding the individual hair strands of the extension together. When the polymer is heated with an application tool, the polymer, and thus the end of the extension, bonds to the strands of the client's own hair. The extensions are applied one at a time, and, because each extension comprises a limited number of individual hair strands, a large number of extensions is usually required in order to provide the desired effect. Therefore the process of applying the extensions is time consuming and usually requires several hours to complete. To expedite the process, the stylist should have ready access to each extension. Unfortunately, this often requires an assistant to hand the stylist each individual extension. As an alternative, the stylist might lay the extensions out flat on a stand or table and reach for them as the need arises. Unfortunately, when presented in this manner, the extensions often become disarrayed or tangled with one another, requiring the stylist to suspend the application process to untangle the extensions.

Moreover, it is often desirable to treat the extensions before applying them to a client. For example, the color or shade of the extension may require alteration or the length of the extension may require adjustment or the extension may have more curl than desired, so a relaxing agent is sprayed on the hair. It is often desirable to treat the extensions in these or other ways before applying the extensions to the client's hair. However, it is to be appreciated that handling the extensions during these processes can be difficult and aggravating.

Finally, it is often desirable for a stylist to be able to display to the client in an organized manner the extensions the stylist proposes to apply to the client's hair.

SUMMARY OF THE INVENTION

The present invention is directed to an apparatus for solving the above-identified problems and accomplishing the desired goals. A rack is disclosed which allows the stylist to organize the extensions in a manner which expedites the application process, maintaining each extension untangled from the others. The apparatus allows the stylist to easily locate each extension during the application process and to remove it from the apparatus. Moreover, the rack holds the extensions in place during any desired pre-application treatments, and even allows blow drying the extensions without the hair becoming tangled. The disclosed rack allows a stylist to display the extensions to a client prior to application so that the client may appreciate the length, color and other features of the proposed application.

The apparatus comprises a vertical ground-engaging stand comprising a vertical member having a first end and a second end. A tripod or base is attached to the first end, the tripod or base suitable for maintaining the vertical member in a stable vertical position. The second end of the vertical member is threaded. A cylindrical drum member having an open end and a closed end with a hole in the center of the closed end is placed on the second end, the hole fitting over the threads of the second end. The open end and closed end of the drum member define a longitudinal axis. The wall of the cylindrical drum has a plurality of slots which extend parallel to the longitudinal axis, the slots extending from the open end into the wall. A wingnut or other fastener may be used to attach the drum member to the second end of the vertical member. The wingnut may be loosened when the device is in use to allow the easy rotation of the drum and the rack arms attached to the drum, allowing the stylist to rotate the hair extensions within the rack according to need and utility.

A plurality of rack arms are attached to the cylindrical drum, each rack arm radiating outwardly from the drum. Each rack arm comprises a plurality of parallel and spaced apart teeth, the teeth generally transverse to the main axis of the rack arm. The grooves between the teeth are adapted to receive hair extensions. The teeth are sufficiently wide to allow sufficient spacing between the extensions so that there is sufficient room for the stylist's fingers to individually grasp an extension. The stylist hangs the extensions between the teeth of each rack arm, the end of each extension having polymer or other substance or structure of sufficient width at the end of the extension to prevent the extension from falling through the groove. The extensions are securely retained within the grooves between the teeth, such that the stylist may perform a variety of operations upon the extensions, including such operations as combing, coloring, straightening, applying rollers for permanent waving, and blow drying the extensions.

DETAILED DESCRIPTION OF THE INVENTION

Figure 1:
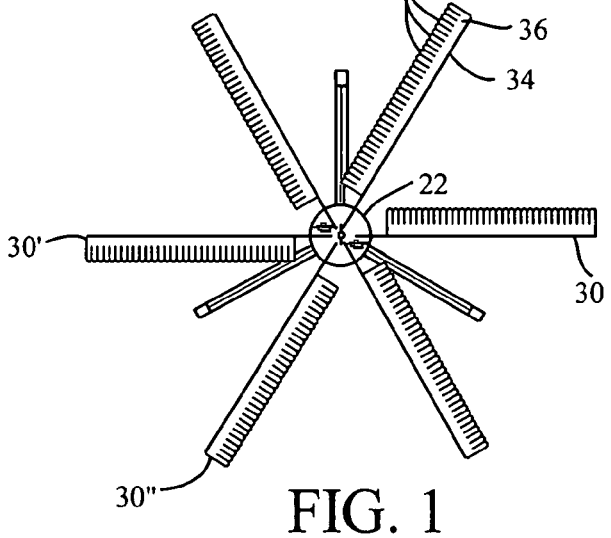
FIG. 1 is a top view of one embodiment of the disclosed apparatus.
Figure 2:
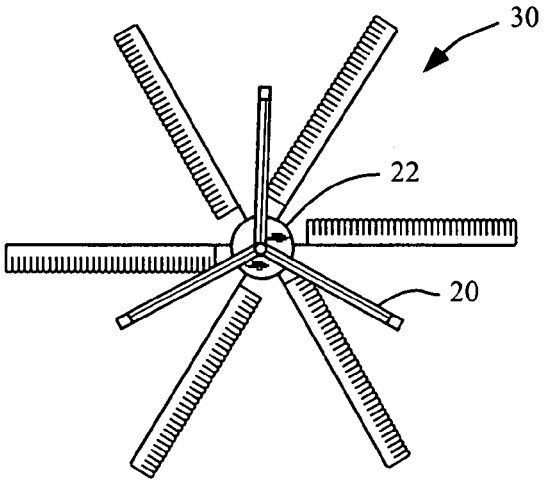
FIG. 2 is a bottom view of the embodiment of FIG. 1.
Figure 8:
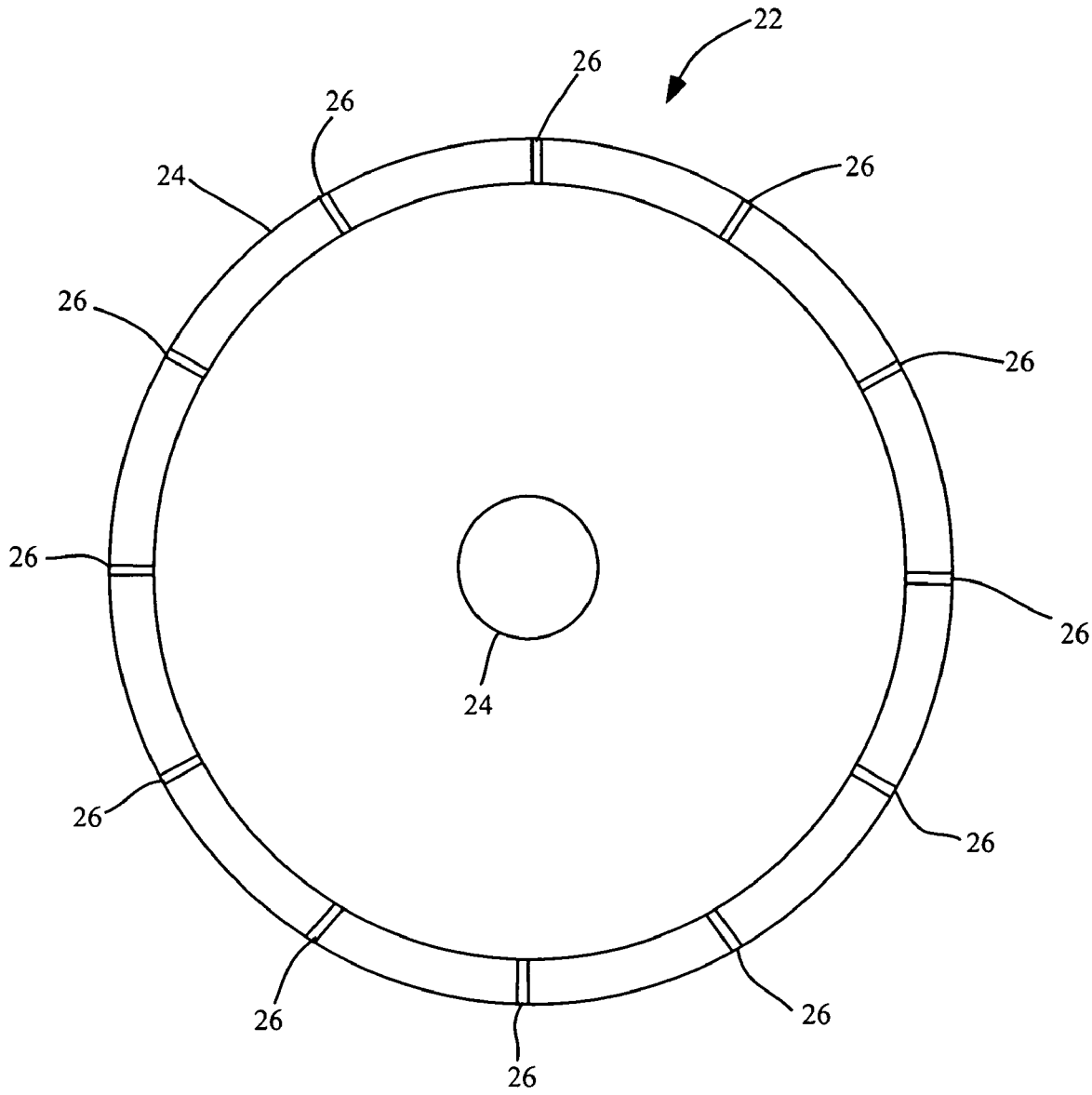
FIG. 8 is a top view of one embodiment of a cylindrical drum which may be used with the disclosed apparatus.

Referring to FIG. 1, an embodiment of the disclosed hair rack 10 comprises a vertical ground-engaging stand 12. The vertical stand 12 comprises a vertical member 14 having a first end 16 and a second end 18. Ground-engaging standing means, such as tripod 20, or other type of base member capable of retaining the ground-engaging stand in a vertical position, is attached to the first end 16. The second end 18 of the vertical member 14 is adapted to receive a cylindrical drum member 22. For example, the second end 18 may be threaded and the cylindrical drum member 22 may have an opening 24 having threads corresponding with the threads of the cylindrical drum member, as shown in FIG. 8.

The cylindrical drum member 22 is disposed on the second end 18 of the vertical member 14, wherein the cylindrical drum member has a vertical axis generally aligned with the longitudinal axis of the vertical member 18, and a horizontal axis generally perpendicular to the longitudinal axis. The cylindrical drum member 22 has peripheral wall 24. The peripheral wall 24 comprises a plurality of slots 26 extending radially through the peripheral wall. If cylindrical drum member 22 is not connected to second end 18 with threads, a wingnut 28 or other fastener may be used to attach the cylindrical drum member to the second end 18 of the vertical member 14. The wingnut 28 may be loosened when the device is in use to allow the easy rotation of the drum member 22 and the rack arms 30 attached to the drum member, allowing the stylist to rotate the hair extensions within the rack according to need and utility.

Figure 3:
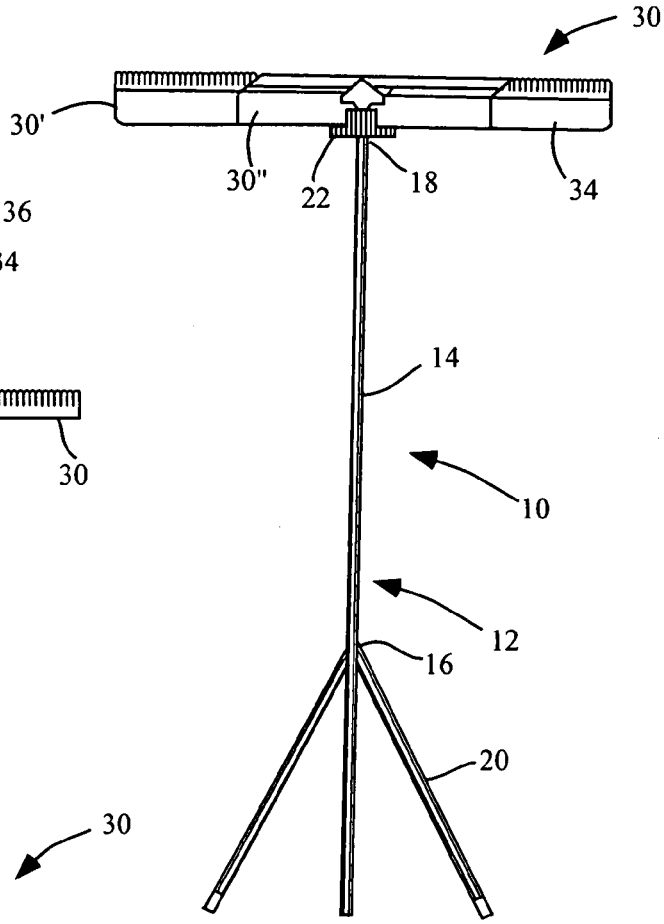
FIG. 3 is a side view of the embodiment of FIG. 1.
Figure 6:
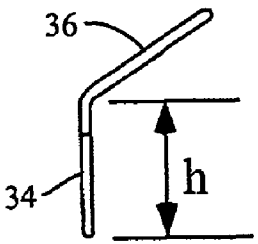
FIG. 6 is a side view of the rack arm shown in FIG. 5.

A plurality of rack arms 30 are attached to the cylindrical drum member 22, each rack arm radiating outwardly from the drum member. Each rack arm 30 comprises an attachment end 31 which is adapted to attach to the cylindrical drum member 22. For example, the attachment end 31 may have a slot 32 adaptable for being received by a corresponding slot 26 of the cylindrical drum 22. Each rack arm 30 further comprises a lower vertical section 34 and an upper angled section 36 wherein as shown in FIG. 6 the lower vertical section 34 defines a first plane and the upper angle section 36 defines a second plane with the angle between the first and second planes being in the range from 115 to 145 degrees. More particularly, as shown in FIG. 6, the obtuse angle is formed by the lower vertical section 34 and the upper angled section 36. This angle is also seen in FIG. 3, which shows the edge of rack arm 30" superimposed against rack arm 30'. It has been found that an angle in the range 115 to 145 degrees and, more preferably, an angle of approximately 130 degrees makes it easier for the stylist, who may be standing, to reach beneath the teeth 38 to grasp the extension, without raking his or her fingers against the edge of the upper angled section 36.

Figure 5:
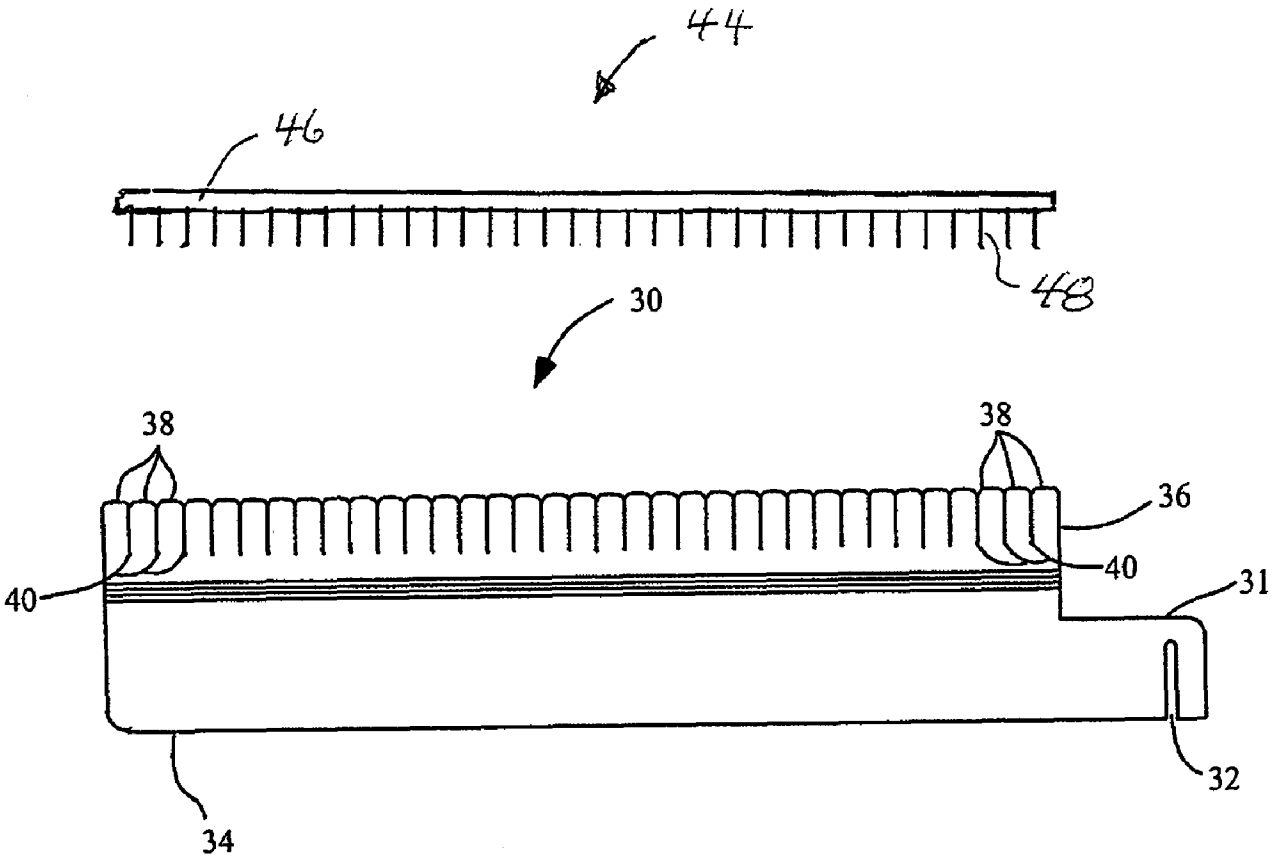
FIG. 5 is a front view of an embodiment of a rack arm, a locking device for locking extensions within the grooves of the rack arm being shown next to the rack arm.

The upper angled section 36 comprises a plurality of parallel and spaced apart teeth 38, the teeth transverse to the main axis of the rack arm 30. Each tooth 38 is greater than a quarter inch in width. The ends of each tooth may be tapered as shown in FIG. 5 such that the slots between each tooth widen at the leading edge. An optional locking device may be used which fits over the upper angled section of each rack arm 30, where the locking device comprises a plurality of parallel and spaced apart teeth which close over the spaced apart teeth of the rack arm. When the locking device is utilized, the apparatus may be transported without risk of the extensions falling off of the rack arm 30. In addition, use of the locking device allows treatment of the extensions, such as brushing, without the risk of the extensions being pulled off of the rack arm.

The grooves 40 between the teeth 38 are adapted to receive hair extensions, where grooves are sized such that the polymer structure at the end of the extension is sufficiently large to prevent the polymer structure from falling through the groove, thus preventing the extension from falling to the ground. For example, the width of the groove (i.e., the space between the teeth 38) may be sized at approximately 1/32 inch. If the rack arm is configured as shown in FIG. 6, the upward facing angle of the teeth 38 allows the stylist easy access to reach beneath each tooth and grab an extension. The grooves 40 are sufficiently spaced apart by the width of the teeth 38 to allow sufficient spacing between the extensions so that there is sufficient room for the stylist's fingers to individually grasp an extension. An acceptable tooth width is 5/16 inch.

If the rack arm 30 is configured as shown in FIG. 6, the angle of the upper angled section 36 allows easy placement of the extensions on the rack 10, where the stylist is able to use the assistance of gravity to prevent the extensions from becoming tangled together, which otherwise occurs when the extensions are laid on a horizontal surface. The stylist hangs the extensions in the grooves 40 between the teeth 38 of the rack arms 30. While in the rack 10, the extensions hang vertically. As shown in FIG. 6, the lower vertical section 34 of each rack arm 30 has sufficient vertical length h to provide a backup for the extensions hanging therefrom, such that when the stylist reaches in to remove an extension from the rack 10 for attachment to the client's hair, the upper portion of the extension lays against the lower vertical section of the rack arm. This allows the stylist to use the lower vertical section 34 as a backup when pinching the upper portion of the extension between his or her fingers without pushing the extension away.

The extensions are securely retained within the grooves 40 between the teeth 38, such that the stylist may perform a variety of operations upon the hair extensions, including such operations as combing, coloring, straightening, applying rollers for permanent waving, and blow drying the extensions. In addition, the rack 10 securely retains the extensions despite the frequent use of blow dryers in a salon environment, or wind or the disturbance caused by a passing person which, if the extensions were simply laid out on a table or stand, would cause the extensions to become tangled. A locking device, 44 in FIG. 5, comprising a plurality of teeth 46 attached to a spine member 48 may be used to further lock the extensions within the grooves 40 of each rack arm. The teeth 46 of the locking device 44 are adapted to fit within the grooves 40 of the rack arm, thereby securing the extensions within the grooves.

Figure 7:
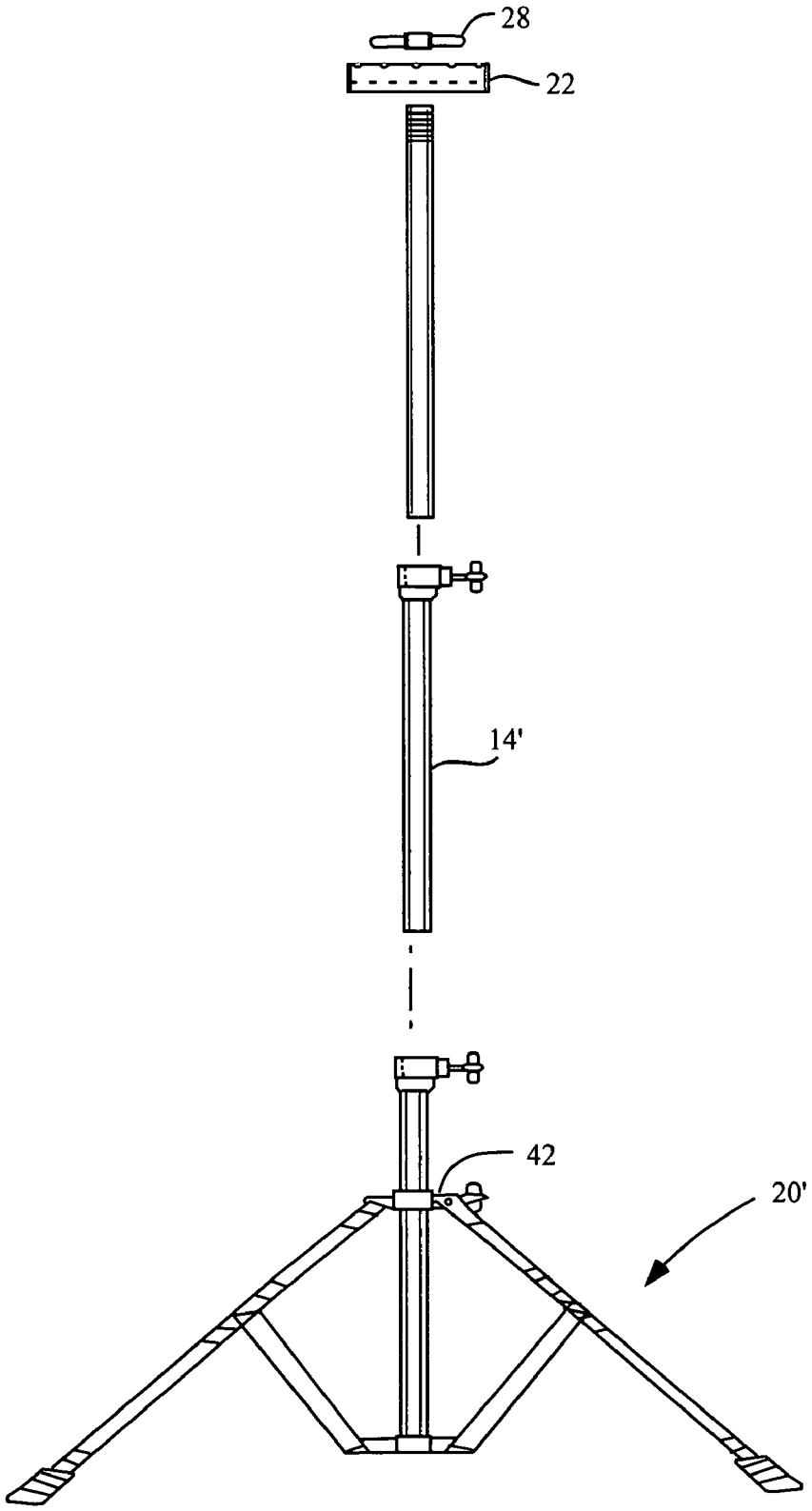
FIG. 7 is an exploded view of one embodiment of the disclosed device, without the hair racks attached.
Figure 9:
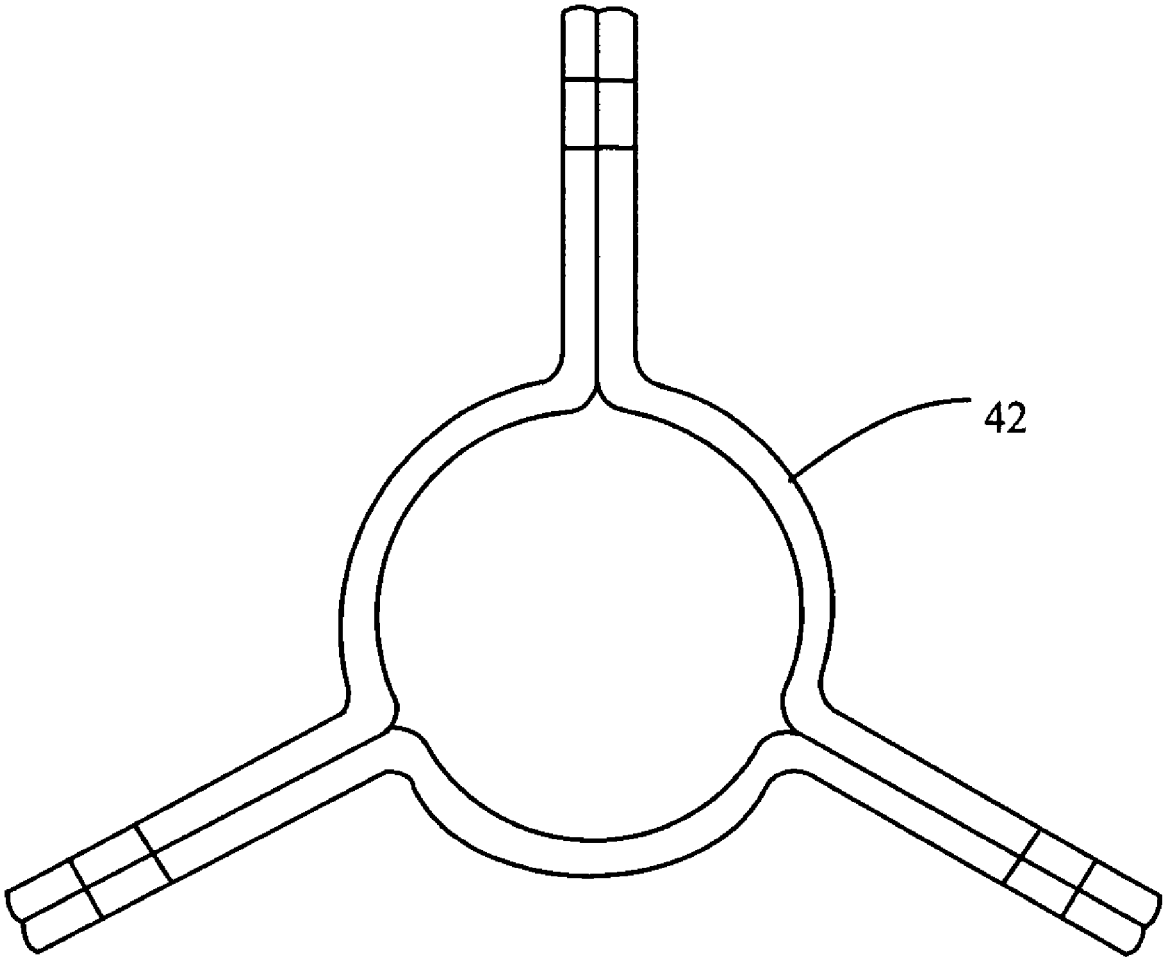
FIG. 9 is a top view of one embodiment of a leg hanger which may be used with the disclosed apparatus.

As shown in the figures, a variety of options may be employed with the disclosed apparatus. As shown in FIG. 7, a telescoping vertical member 14' may be used so that the height of the rack arms 30 is adjustable. The ground engaging stand may be a fixed tripod 20 as shown in FIG. 3, collapsible tripod 20' as shown in FIG. 7, or the ground engaging stand may comprise a round or square base. The collapsible tripod 20' may comprise a leg hanger 42 as shown in FIG. 9. It has been found that for a rack 10 where the rack arms extend approximately 15 inches from the cylindrical drum member 22 (i.e., the rack arms extending from either side of the drum member define a diameter of approximately 30 inches) the rack is sufficiently stable if the legs of a tripod stand define a diameter of approximately 16 inches.

Figure 4:
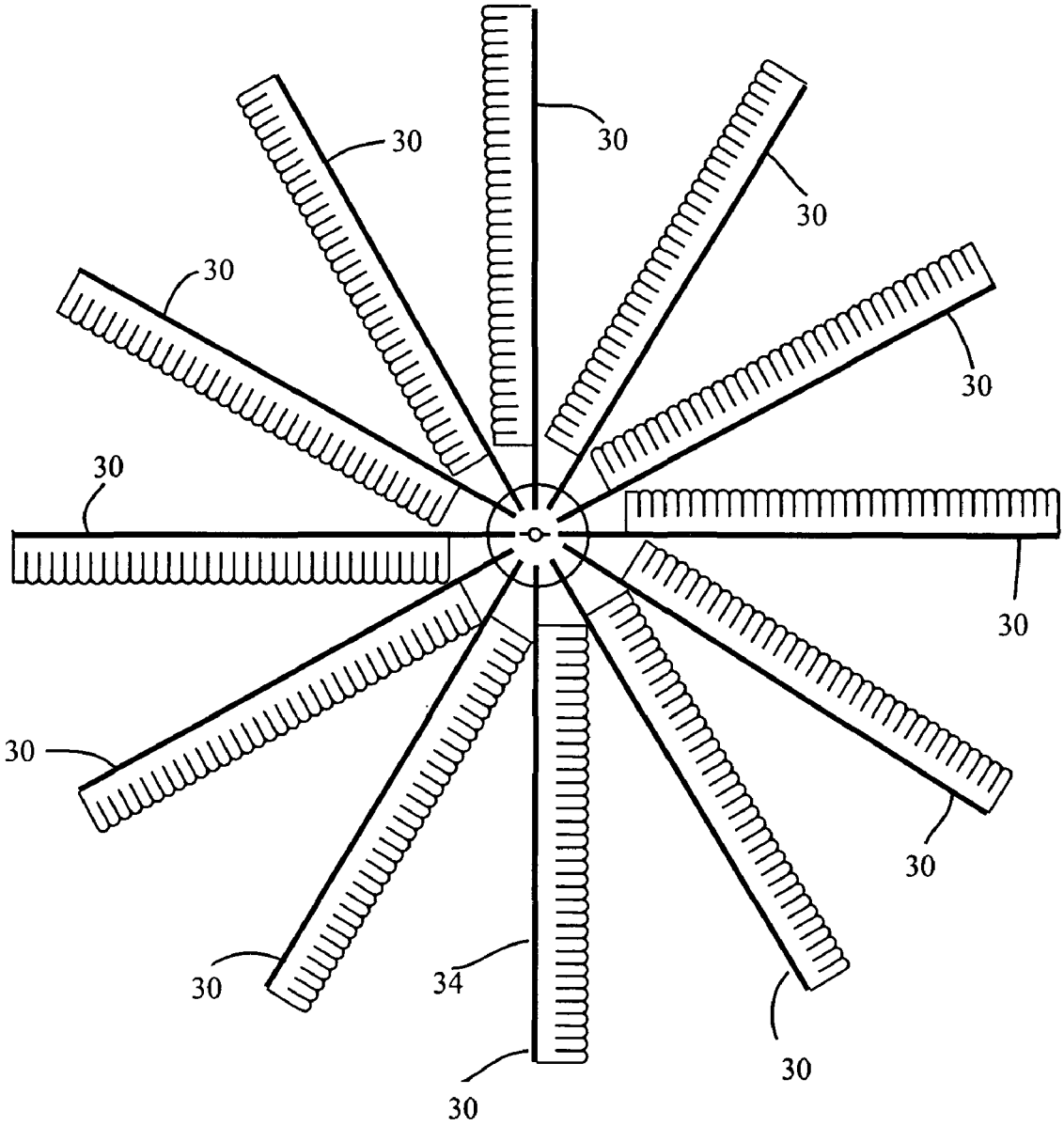
FIG. 4 is a top view of an alternative embodiment of a rack arm arrangement for the disclosed apparatus.

The rack arms 30 are removable and thus the stylist may employ as many rack arms as desired for a particular client. For example, FIG. 4 shows an embodiment having twelve rack arms 30. FIG. 8 shows a cylindrical drum member 22 which has sufficient slots 26 for receiving twelve rack arms 30. The number of teeth per rack arm may vary according to the length of the rack arm and the desires of the user.

The components of the rack 10 may be manufactured from a variety of materials, including metal, such as stainless steel, and plastic. The vertical stand 14 may be manufactured from stainless steel tubing.

Additional features of the device, such as leg attachments, locking clamps and attachment devices may be added by those skilled in the art of the invention, thus the invention should not be limited by the embodiments shown in the drawings. It is to be appreciated that alternative embodiments of the generalized embodiment might include other modifications. While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A rack for retaining hair extensions comprising:

a vertical member having a first end and a second end;

a ground-engaging standing means attached to the first end;

a cylindrical drum member attached to the second end; and an elongated rack arm extending radially from the cylindrical drum member, the rack arm comprising a plurality of parallel and spaced apart teeth, wherein a groove is defined between each pair of adjacent teeth, each groove adapted to retain a hair extension wherein the rack arm as seen in side view comprises a lower vertical section and an upper angled section having a lower end adjoining an upper end of the lower vertical section, the sections being elongated in the direction of elongated of the rack arm wherein the lower vertical section defines a first plane and the upper angled section defines a second plane and the angle between the first plane and the second plane is in the range from 115 to 145 degrees, and wherein the teeth and the grooves defined between each pair of teeth are formed in an upper end of the upper angled section and extend downwardly in the upper angled section to a location proximate the upper end of the lower vertical section such that hair extensions retained in the grooves hang vertically from the grooves in the upper angled section and lay against the lower vertical section, the lower vertical section having sufficient vertical length to provide a backup for the extensions when a stylist reaches in and pinches an upper portion of an extension between his or her fingers to remove an extension from the rack.

2. The rack of claim 1 wherein the rack arm comprises an attachment end, the attachment end having a slot, the slot attaching the rack arm to the cylindrical drum member.

3. The rack of claim 2 wherein the cylindrical drum member comprises a slot corresponding with the slot of the rack arm.

4. The rack of claim 1 wherein the ground-engaging standing means comprises a tripod.

5. The rack of claim 1 wherein the width of the groove is approximately 1/32 inch.

6. The rack of claim 1 wherein each tooth has a width of approximately 5/16 inch.

7. The rack of claim 1 wherein the vertical member has means for height adjustment.

8. The rack of claim 7 wherein the means for height adjustment comprises a telescoping vertical member.

9. The rack of claim 1, wherein the rack arm has an attachment end for removably attaching the rack arm to the cylindrical drum.

10. The rack of claim 1, comprising a plurality of said rack arms extending radially from the cylindrical drum member in spaced relation, each rack arm having an attachment end for removably attaching the arm to the cylindrical drum.

11. The rack of claim 1, further comprising a lock device having a spine and teeth adapted to fit within respective ones of the grooves in the rack arm for locking extensions within the grooves.

12. An apparatus for assisting a hair stylist in preparing and applying hair extensions to a person's head, the apparatus comprising:

a vertical stand with a ground-engaging base and an upper portion with a mount for supporting a plurality of elongated rack arms;

a plurality of rack arms each removably attachable to the rack arm mount so as to extend radially from the rack arm mount, each rack arm including a plurality of parallel and spaced apart teeth, wherein a groove is defined between each pair of adjacent teeth, each groove adapted to rain a hair extension, wherein the rack arm further comprises a lower vertical section and an upper angled section having a lower end adjoining an upper end of the lower vertical section, the sections being elongated in the direction of elongated of the rack arm wherein the lower vertical section defines a first plane and the upper angled section defines a second plane and the angle between the first plane and the second plane is in the range from 115 to 145 degrees, and wherein the teeth and the grooves defined between each pair of teeth are formed in an upper end of the upper angled section and extend downwardly in the upper angled section to a location proximate the upper end of the lower vertical section such that hair extensions retained in the grooves hang vertically from the grooves in the upper angled section and lay against the lower vertical section, the lower vertical section having sufficient vertical length to provide a backup for the extensions when a stylist reaches in and pinches an upper portion of an extension between his or her fingers to remove an extension from the rack.

* * * * *